United States Patent [19]

Lewis

[11] 4,368,403

[45] Jan. 11, 1983

[54] ELECTRON GUN INCLUDING SUPPORT STRUCTURE FOR ACCELERATING LENS

[75] Inventor: David W. Lewis, High Wycombe, England

[73] Assignee: The M-O Valve Company Limited, London, England

[21] Appl. No.: 182,006

[22] Filed: Aug. 28, 1980

[30] Foreign Application Priority Data

Jul. 9, 1980 [GB] United Kingdom ..... 8022415

[51] Int. Cl.[3] ..... H01J 29/48; H01J 29/82

[52] U.S. Cl. ..... 313/457; 313/451; 313/292

[58] Field of Search ..... 313/436, 451, 456, 457, 313/292, 417, 438, 449, 448

[56] References Cited

U.S. PATENT DOCUMENTS 2,916,649 12/1959 Levin ..... 313/456 X
3,278,786 10/1966 Kreisman ..... 313/284 X

FOREIGN PATENT DOCUMENTS 260617 8/1964 Australia ..... 313/436
929849 6/1963 United Kingdom .

*Primary Examiner*—Palmer C. Demeo
*Attorney, Agent, or Firm*—Kirschstein, Kirschstein, Ottinger & Cobrin

[57] ABSTRACT

In an electron gun, e.g. for a cathode ray tube, an anode is supported from another anode by spacers which fit between overlapping portions of the two anodes and locate in recesses in the two overlapping portions. The spacers are typically glass balls. The invention finds especial application in mounting of a final anode whose diameter is greater than the diameter on which rods supporting the other electrodes of the gun lie.

4 Claims, 2 Drawing Figures

ELECTRON GUN INCLUDING SUPPORT STRUCTURE FOR ACCELERATING LENS

This invention relates to electron guns.

The invention relates particularly to electron guns of the kind comprising at least two tubular electrodes disposed coaxially at different positions along the path of the electron beam produced by the gun. Such electron guns are commonly used in cathode ray tubes (CRTs), the tubular electrodes forming an electron beam lens.

According to the present invention in an electron gum comprising at least two tubular electrodes disposed coaxially at different positions along the path of the electron beam, one of the electrodes is at least partly supported from the other by means of spacer members which fit between overlapping portions of the electrodes of different diameters and locate in recesses in said portions.

In one particular arrangement according to the invention each spacer member fits into a respective recess in one of the electrodes and into a respective part of an annular groove in the other electrode.

The respective recesses may be in the form of apertures extending through the electrode, in which case the respective recesses are preferably in the outer of the two electrodes since it is desirable that the spacer members are electrically screened from the electron beam.

The spacer members are suitably in the form of spheres and consist of insulating material, e.g. glass, or an electrically conductive material, e.g. non-magnetic steel, according to whether the two electrodes are required to operate at different potentials or the same potential.

Normally three or more spacer members are provided and the spacer members are equally spaced.

One particular advantage of an electron gun in accordance with the invention is that it facilitates the provision of an electrode whose diameter is only slightly less than the diameter of the electron gun enclosure, e.g. in the case of a CRT, the neck of the CRT. In a CRT the electron gun structure is commonly supported from insulating rods which extend axially along the gun outside the electrodes. By using the invention the final anode of a CRT electron gun may be supported from the penultimate anode and have a diameter as large or larger than the diameter on which the support rods lie. Thus, the invention finds particular application to CRT electron guns employing accelerating lenses.

However, the invention also finds application in other contexts since it provides a very simple method of supporting an electrode which does not involve the use of heat, as do other commonly used electron gun fabrication techniques.

Figure 1:
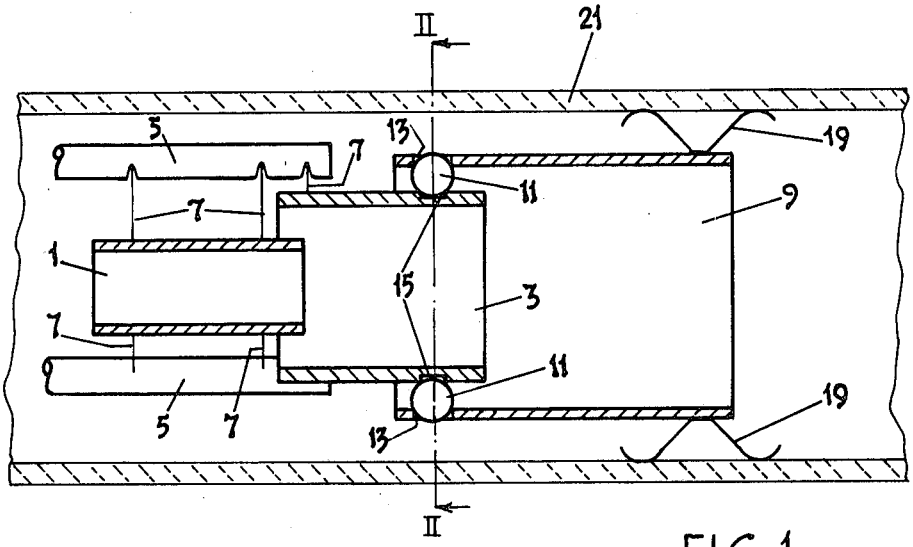
Figure 2:
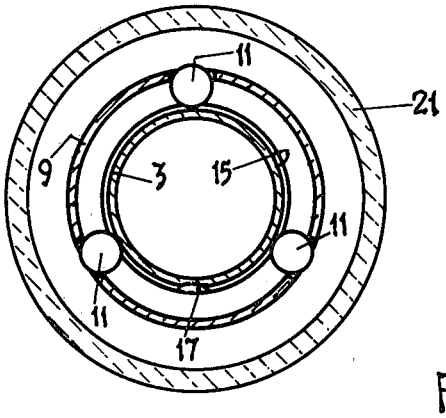

One electron gun in accordance with the invention will now be described by way of example with reference to the accompanying drawing in which FIG. 1 is a sectional side view of part of the electron gun; and FIG. 2 is a sectional view along the line II—II in FIG. 1.

The electron gun is intended for use in an electrostatically focussed CRT of the projection type and utilises a four anode accelerating lens.

Apart from the final anode the electron gun is of conventional form, FIG. 1 showing the last three anodes only.

Referring to the drawings, the second anode 1, and the third anode 3 are supported from three glass rods 5 which extend parallel to the axis of the electron gun outside the anodes 1 and 3, the rods 5 being equally spaced around the anodes.

Each of the anodes 1 and 3 comprises a metal tube having radially extending horns 7 on which the rods 5 are impaled, assembly being accomplished by moving the rods radially inwards onto the pointed ends of the horns whilst the rods are locally softened by heating.

The fourth anode 9 comprises a metal tube of larger diameter than the third anode 3 and is supported from the end of the third anode 3 further from the second anode 1 in overlapping relationship therewith by means of three glass spheres 11. Each sphere 11 locates in a respective circular aperture 13 in the part of the fourth anode 9 overlapping the third anode 3 and in an annular groove 15 formed in the outer surface of the third anode.

To facilitate assembly there is provided at one location around the groove 15 a dimple 17 which is deeper than the groove 15. To secure the fourth anode 9 to the third anode 3, one of the glass spheres 11 is placed in the dimple 17 and the other two spheres 11 are placed in respective apertures 13 in the fourth anode 9, the spheres being temporarily secured by a jig. Using the leeway provided by the extra depth of the dimple 17 the fourth anode 9 is then manipulated over the end of the third anode 3 until the spheres 11 secured to the fourth anode 9 are adjacent the groove 15 in the third anode 3, and the sphere 11 secured in the dimple 17 is adjacent the vacant aperture 13 in the fourth anode 9. The fourth anode 9 is then rotated with respect to the third anode 3 through about 60° keeping all three spheres 11 located in their respective apertures in the fourth anode. This pushes the spheres 11 fully home into the apertures firmly securing the fourth anode 9 to the third anode 3 and disposes the dimple 17 well away from coincidence with any aperture 13.

At the end of the fourth anode 9 further from the third anode 3 centering springs 19 are provided which contact the inner surface of the neck 21 of the CRT envelope and thereby prevent relative rotation of the third and fourth anodes and further support the fourth anode.

In one particular embodiment of the electron gun described by way of example designed for operation with the fourth anode at 50 kilovolts, the spheres 11 have a diameter of 5 millimeters.

In a modification of the arrngement shown in FIGS. 1 and 2, the spheres 11 locate in an annular groove in the inner surface of the fourth anode 9, instead of in respective apertures. In such an arrangement a relatively large number of spheres may be used so that the assembly resembles a ball race, and the spacer members may be other than spherical, for example, cylindrical.

It will be appreciated that whilst the electron gun described by way of example has only one electrode supported from another electrode in accordance with the invention, other electron guns may employ two or more such electrodes.

I claim:

1. A cathode ray tube incorporating an electron gun including an accelerating lens comprising at least two tubular electrodes disposed coaxially at different positions along the path of the electron beam produced by the gun wherein the final electrode of the lens is at least partly supported from the adjacent electrode by means of at least three spherical spacer members which fit between overlapping portions of said final and adjacent electrodes of different diameters and are axially located in recesses in said portions, said adjacent electrode is supported from rods extending parallel to the axis of the electron gun outside said adjacent electrode, and said final electrode has a diameter at least as large as the diameter on which the support rods lie.

2. A cathode ray tube according to claim 1 wherein each spherical spacer member fits into a respective recess in said final electrode and into a respective part of an annular groove in the adjacent electrode.

3. A cathode ray tube according to claim 2 wherein the respective recesses are in the form of apertures extending through the electrode.

4. A cathode ray tube according to claim 3 wherein said groove is provided with a dimple to facilitate assembly.

* * * * *